US006151943A

United States Patent [19]

Nihei et al.

[11] Patent Number: 6,151,943

[45] Date of Patent: Nov. 28, 2000

[54] ROLLING MACHINE AND ROLLING METHOD

[75] Inventors: Mitsuo Nihei, Hitachi; Minoru Igari, Ibaraki-ken; Takehiko Saito; Yoshio Takakura, both of Hitachi, all of Japan

[73] Assignee: Hitachi, Ltd., Tokyo, Japan

[21] Appl. No.: 09/357,854

[22] Filed: Jul. 21, 1999

[30] Foreign Application Priority Data

Jan. 21, 1998 [JP] Japan ..... 10-204748

[51] Int. Cl.[7] ..... B21B 13/14; B21B 31/07

[52] U.S. Cl. ..... 72/241.2; 72/243.2

[58] Field of Search ..... 72/241.2, 241.4, 72/241.6, 241.8, 247, 243.2, 243.4, 243.6

[56] References Cited

U.S. PATENT DOCUMENTS

| | | |
|---|---|---|
| 4,194,382 | 3/1980 | Kajiwara . |
| 5,666,837 | 9/1997 | Kajiwara et al. . |
| 5,768,927 | 6/1998 | Kajiwara et al. . |
| 5,839,313 | 11/1998 | Ginzurg et al. . |

FOREIGN PATENT DOCUMENTS

| | | | |
|---|---|---|---|
| 55-36062 | 3/1980 | Japan . | |
| 61-279305 | 12/1986 | Japan . | |
| 5-285503 | 4/1994 | Japan | 72/243.6 |
| 6-11441 | 4/1994 | Japan | 72/243.6 |

*Primary Examiner*—Rodney A. Butler
*Attorney, Agent, or Firm*—Evenson, McKeown, Edwards & Lenahan, P.L.L.C.

[57] ABSTRACT

There are provided a rolling machine and a rolling method in which the strip crown and shape control capability for a narrow-width strip is improved, so that the adequate strip crown and shape control capability for strips of various widths from a narrow width to a larger width can be secured. In the rolling machine, a pair of upper and lower working rolls are supported respectively by a pair of upper and lower intermediate rolls, and the intermediate rolls are supported respectively by a pair of upper and lower reinforcing rolls. The reinforcing rolls have an effective barrel length which is smaller than an effective barrel length of the working rolls and the intermediate rolls, and is larger than a width of a minimum-width strip to be rolled. The intermediate rolls are arranged in such a manner that their axes, disposed respectively in substantially horizontal planes, cross each other, and are crossed relative to the working rolls and the reinforcing rolls. The maximum cross angle of the intermediate rolls are increased and decreased in accordance with the width of the strip.

24 Claims, 8 Drawing Sheets

CASE OF LARGE-WIDTH STRIP

CASE OF NARROW-WIDTH STRIP

ROLLING MACHINE AND ROLLING METHOD

BACKGROUND OF THE INVENTION

This invention relates to a rolling machine (rolling mill) and a rolling method for rolling a sheet (strip), and more particularly to a rolling machine and a rolling method which can secure a strip crown and shape control capability for various strips from a narrow-width strip to a large-width strip.

In the sheet-rolling field, it is always required to enhance the quality of strips, and various studies and developments have heretofore been made in order to enhance the dimensional accuracy of strips. Particularly, the quality of the strip is influenced directly by the quality of the strip crown and shape of the strip, and therefore various types of rolling machines have heretofore been proposed for the purpose of enhancing the control capability for the strip crown and shape.

For example, in a four-stage rolling machine, working roll bending devices for imparting a bending force to working rolls were used in the past as means for controlling the strip crown and shape. With this method, however, the strip crown and shape could not be adequately controlled for various kinds of strip materials according to the need for various thicknesses and widths of the strip.

Therefore, rolling machines, having a higher strip crown and shape control capability, have thereafter been proposed and put into practical use.

One such example is a six-stage rolling machine comprising a pair of upper and lower working rolls, axially-movable intermediate rolls supporting these working rolls, respectively, and reinforcing rolls supporting these intermediate rolls, respectively. Another example is such a six-stage rolling machine in which each of the intermediate rolls has a S-shaped initial crown.

In these six-stage rolling machines, although the strip crown and shape control capability was considerably improved, it was difficult to secure the satisfactory strip crown and shape control capability for strips of various widths from a narrow-width to a large-width. More specifically, in the former six-stage rolling machine, the strip crown and shape control capability was not adequate for large-width strips, and in the latter six-stage rolling machine with the intermediate rolls each having the special initial crown, the strip crown and shape control capability for narrow-width strips was not adequate.

In both of the above six-stage rolling machines, the compressing position difference (leveling difference) between the operating side and the drive side was liable to occur because of the axial movement of the intermediate rolls, and considerable time and labor were required for adjusting it, and this tendency was conspicuous particularly with the latter six-stage rolling machine with the special initial crown.

In the recent continuous cold and hot rolling, it has often been required to greatly change the strip crown and shape instantaneously during the rolling operation. However, with the control depending on the axial movement, the speed of movement is limited, which has resulted in a problem that the satisfactory control response can not be obtained.

On the other hand, there have been proposed rolling machines which achieve a higher strip crown and shape control capability than the conventional four-stage rolling machines without the need for axial movement of the intermediate rolls as in the above six-stage rolling machines, and with this construction, the above problem, related to the leveling difference between the operating side and the drive side, and the above control response problem were overcome. Example of such rolling machines include a six-stage/five-stage rolling machine as disclosed in JP-A-53-66849 (U.S. Pat. No. 4,194,382) in which the axial length (barrel length) of reinforcing rolls is smaller than that of working rolls and intermediate rolls, and intermediate roll bending devices are provided, and a six-stage/five-stage rolling machine of the intermediate roll cross-type as disclosed in JP-A-61-279305, JP-A-55-36062 and U.S. Pat. No. 5,839,313 in which intermediate rolls are disposed in a crossed manner.

However, these rolling machines still have a problem that it is difficult to secure the strip crown and shape control capability for strips of various widths from a narrow width to a large width.

More specifically, in the former rolling machine with the short-barrel reinforcing rolls, a drawback of the bending that its effect becomes smaller toward the central portion of the strip is covered by the short-barrel design of the reinforcing rolls, and as a result, opposite side edge portions of a large-width strip are disposed outwardly of the opposite ends of the reinforcing rolls, and the resultant shape is such that a large concave crown is formed, and the central portion of the strip is excessively extended, thus failing to provide the desired strip crown and shape. If the barrel length of the reinforcing rolls is increased in order to overcome this difficulty, the strip crown and shape control capability for narrow-width strips is inadequate.

In the latter rolling machine of the intermediate roll cross-type, the intermediate rolls are crossed, so that a gap is formed between each intermediate roll and the associated working roll so as to provide an apparent roll crown, thereby controlling the strip crown and shape. The gap, produced at this time, is increasing toward the opposite side edges of the strip, and is decreasing toward the central portion of the strip. Therefore, the adequate strip crown and shape control capability is obtained for a large-width strip, but can not be obtained for a narrow-width strip.

As described above, in the rolling machine with the short-barrel reinforcing rolls and the rolling machine of the intermediate roll cross-type, although the strip crown and shape control capability, higher than that of the conventional four-stage rolling machines, could be achieved without suffering from the problem concerning the leveling difference between the operating side and the drive side, and the control response problem, it was difficult to secure the satisfactory strip crown and shape control capability for strips of various widths from a narrow width to a large width.

As described above, the six-stage/five-stage rolling machine with the short-barrel reinforcing rolls is advantageous in the improvement of the strip crown and shape control capability for a narrow-width strip while the six-stage/five-stage rolling machine of the intermediate roll cross-type is advantageous in the improvement of the strip crown and shape control capability for a large-width strip. Therefore, it may be proposed to secure the satisfactory strip crown and shape control capability for strips of various widths from a narrow width to a large width by combining the two rolling machines together. In this case, however, when comparing the range of the control for a narrow-width strip with the range of the control for a large-width strip, the former is inevitably extremely smaller than the latter, and this is not the essential improvement of the strip crown and shape control capability for narrow-width strips.

SUMMARY OF THE INVENTION

It is an object of this invention to provide a rolling machine and a rolling method, in which by improving a strip crown and shape control capability for narrow-width strips, the adequate strip crown and shape control capability for strips of various widths from a narrow width to a large width can be secured.

(1) According to one aspect of the present invention, there is provided a rolling machine comprising a pair of upper and lower working rolls, a pair of upper and lower intermediate rolls supporting the working rolls, respectively, the pair of intermediate rolls being arranged in such a manner that their axes, disposed respectively in substantially horizontal planes, cross each other, and can be crossed relative to the pair of working rolls and the pair of reinforcing rolls, intermediate roll cross angle-adjusting means for adjusting a cross angle of the intermediate rolls, and a pair of upper and lower reinforcing rolls supporting the intermediate rolls, respectively, and an effective barrel length of the pair of reinforcing rolls being smaller than an effective barrel length of the working rolls and the intermediate rolls, and larger than a width of a minimum-width strip to be rolled.

In the present invention, the high strip crown and shape control capability for a large-width strip can be achieved mainly because of the effect of the intermediate roll cross. More specifically, the upper and lower intermediate rolls are crossed, so that a gap is formed between each intermediate roll and the associated working roll so as to provide an apparent roll crown, thereby controlling the strip crown and shape. The gap, produced at this time, is increasing toward the opposite side edges of the strip, and therefore, the adequate strip crown and shape control capability is obtained for a large-width strip.

The gap, formed between each of the upper and lower intermediate rolls and the associated working roll because of the intermediate roll cross, is decreasing toward the central portion. Therefore, this effect is lowered for a narrow-width strip. In the present invention, the reinforcing rolls have a short barrel length, and this compensates for the above lowered effect, and therefore the high strip crown and shape control capability can be obtained even for a narrow-width strip.

In this case, if the reinforcing rolls have the ordinary barrel length, so-called harmful contact portions are formed outwardly of the opposite side edges of the strip, which results in a disadvantage that the strip crown control is shifted toward the convex crown-producing side. However, with the short barrel design, the effect of preventing this disadvantage can also be achieved.

By providing the intermediate roll cross angle-adjusting means for adjusting the cross angle of the intermediate rolls, the maximum cross angle at the time of rolling a narrow-width strip and the maximum cross angel at the time of rolling a large-width strip can be changed. Therefore, the maximum cross angle at the time of rolling a narrow-width strip (having a width smaller than the effective barrel length of the reinforcing rolls) is made larger than the maximum cross angle at the time of rolling a large-width strip. By doing so, the control range for a narrow-width strip is increased, thereby decreasing the difference between this control range and the control range for a large-width strip, so that the strip crown and shape control capability for a narrow-width strip can be improved. Therefore, the adequate strip crown and shape control capability can be secured for strips of various widths from a narrow width to a large width.

When the strip crown and shape control for a large-width strip is effected, the opposite side edges of the strip are disposed outwardly of the opposite ends of the reinforcing rolls since the reinforcing rolls have the short barrel length, and therefore in some cases, discontinuity points develop on the apparent roll crown applied to the intermediate rolls. However, in the case where the gap to be formed between the intermediate roll and the working roll is the same, the cross angle for a large-width strip can be smaller than that for a narrow-width strip, and therefore the cross angle to be set by the intermediate roll cross angle-adjusting means when rolling a large-width strip can be relatively small. Therefore, these discontinuity points will not cause any particular disturbance which would adversely affect the control.

(2) According to another aspect of the present invention, there is provided a rolling machine comprising a pair of upper and lower working rolls, a pair of upper and lower reinforcing rolls, the reinforcing roll, disposed adjacent to the intermediate roll having an effective barrel length smaller than an effective barrel length of the working rolls and the intermediate roll, and larger than a width of a minimum-width strip to be rolled, and one intermediate roll provided between the upper working roll and the upper reinforcing roll or between the lower working roll and the lower reinforcing roll, the intermediate roll being arranged in such a manner that the intermediate roll, disposed in a substantially horizontal plane, can be crossed relative to the pair of working rolls and the pair of reinforcing rolls, and intermediate roll cross angle-adjusting means for adjusting a cross angle of the intermediate roll.

(3) In the above Item (1) or Item (2), preferably, the intermediate roll cross angle-adjusting means adjusts the cross angle such that the maximum cross angle of the intermediate roll at the time of rolling a narrow-width strip, having a width smaller than the effective barrel length of the reinforcing roll, is larger than the maximum cross angle of the intermediate roll at the time of rolling a maximum-width strip.

(4) In the above Item (3), preferably, the intermediate roll cross angle-adjusting means adjusts the maximum cross angle θ nmax of the intermediate roll at the time of rolling the narrow-width strip, having the width Wn smaller than the effective barrel length L of the reinforcing roll, so as to satisfy the following formula:

$$\theta\ wmax \leqq \theta\ nmax \leqq \theta\ wmax \times (Wwmax/Wn)$$

where θ wmax represents the maximum cross angle of the intermediate roll at the time of rolling the maximum-width strip having the maximum width Wwmax.

With this construction, the amount of displacement from the axis of the roll at the opposite side edges of the strip in a roll-crossed condition is prevented from becoming excessively large, and therefore the good condition of contact between the rolls can be maintained.

(5) In the above Item (1) or Item (2), preferably, there is provided intermediate roll bending means for applying a bending force to the intermediate roll.

(6) In the above Item (1) or Item (2), preferably, there is provided working roll bending means for applying a bending force to the working rolls.

(7) According to a further aspect of the present invention, there is provided a rolling method of rolling by supporting a pair of upper and lower working rolls respectively by a pair of upper and lower intermediate rolls, and supporting the intermediate rolls respectively by a pair of upper and lower reinforcing rolls, the rolling method comprising the step of, applying the pair of reinforcing rolls having an effective barrel length which is smaller than an effective barrel length of the working rolls and the intermediate rolls, and is larger than a width of a minimum-width strip to be rolled, arranging, in the rolling of the strip, the pair of intermediate rolls in such a manner that their axes, disposed respectively in substantially horizontal planes, cross each other, and are crossed relative to the pair of working rolls and the pair of reinforcing rolls, while adjusting a cross angle of the intermediate rolls by intermediate roll cross angle-adjusting means.

(8) According to a further aspect of the present invention, there is provided a rolling method of rolling by providing one intermediate roll between an upper working roll and an upper reinforcing roll or between a lower working roll and a lower reinforcing roll, the method comprising the steps of, providing the reinforcing roll, disposed adjacent to the intermediate roll, having an effective barrel length which is smaller than an effective barrel length of the working rolls and the intermediate roll, and is larger than a width of a minimum-width strip to be rolled, arranging, in the rolling of the strip, the intermediate roll in such a manner that the intermediate roll, disposed in a substantially horizontal plane, is crossed relative to the pair of working rolls and the pair of reinforcing rolls, and adjusting a cross angle of the intermediate roll by intermediate roll cross angle-adjusting means.

(9) In the above Item (7) or Item (8), preferably, the intermediate roll cross angle-adjusting means adjusts the cross angle such that the maximum cross angle of the intermediate roll at the time of rolling a narrow-width strip, having a width smaller than the effective barrel length of the reinforcing roll, is larger than the maximum cross angle of the intermediate roll at the time of rolling a maximum-width strip.

(10) In the above Item (9), preferably, the intermediate roll cross angle-adjusting means adjusts the maximum cross angle θ nmax of the intermediate roll at the time of rolling the narrow-width strip, having the width Wn smaller than the effective barrel length L of the reinforcing roll, so as to satisfy the following formula:

$$\theta\ wmax \leqq \theta\ nmax \leqq \theta\ wmax \times (Wwmax/Wn)$$

where θ wmax represents the maximum cross angle of the intermediate roll at the time of rolling the maximum-width strip having the maximum width Wwmax.

(11) In the above Item (7) or Item (8), preferably, a bending force is applied to the intermediate roll by intermediate roll bending means during the rolling.

(12) In the above Item (7) or Item (8), a bending force is applied to the working rolls by working roll bending means during the rolling.

DESCRIPTION OF THE PREFERRED EMBODIMENTS

One preferred embodiment of the present invention will now be described with reference to the drawings.

Figure 1:
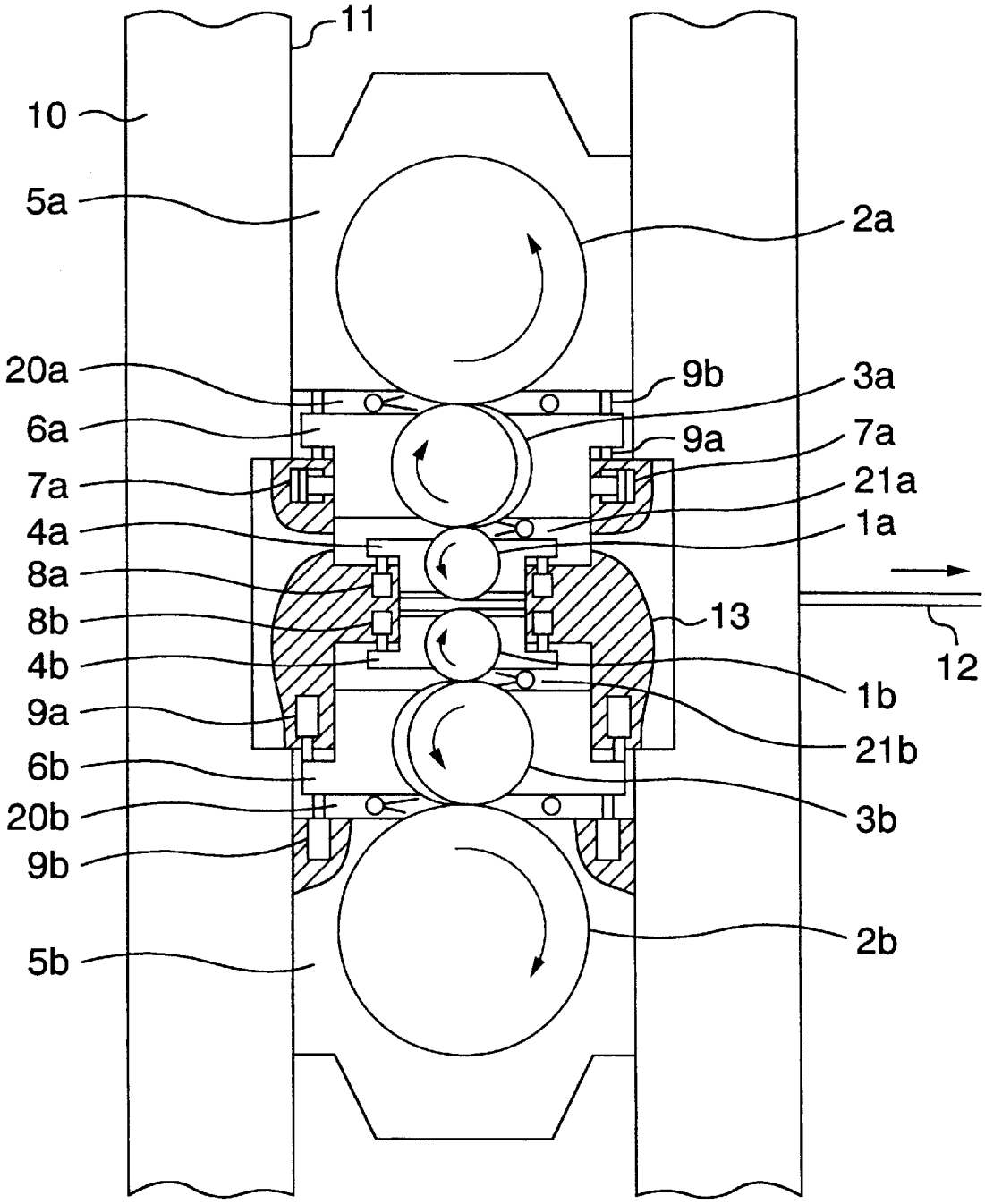
FIG. 1 is a front-elevational view showing the construction of a six-stage rolling machine according to an embodiment of the present invention.
Figure 2:
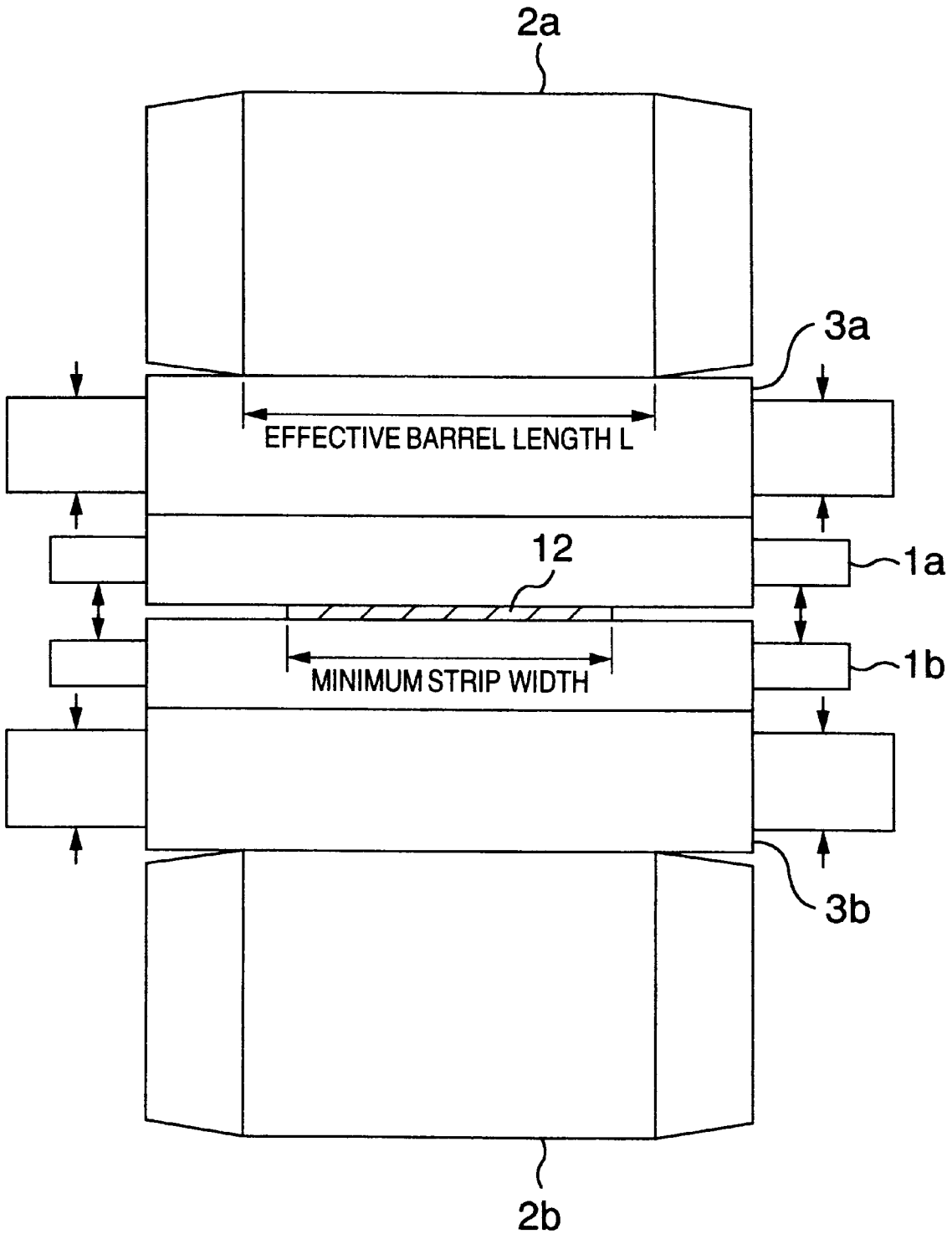
FIG. 2 is a side-elevational view of an important portion of the rolling machine of FIG. 1, showing the arrangement of rolls.

FIG. 1 is a front-elevational view showing the construction of a six-stage rolling machine of the present invention, and FIG. 2 is a side-elevational view of an important portion of this rolling machine, showing the arrangement of rolls. In FIGS. 1 and 2, this rolling machine comprises a pair of upper and lower reinforcing rolls 2*a* and 2*b*, a pair of upper and lower intermediate rolls 3*a* and 3*b* disposed between the pair of reinforcing rolls 2*a* and 2*b*, and a pair of upper and lower working rolls 1*a* and 1*b* disposed between the pair of intermediate rolls 3*a* and 3*b*. The intermediate rolls 3*a* and 3*b* are arranged in such a manner that their axes, disposed respectively in upper and lower planes (substantially horizontal planes) parallel to a plane of a strip 12 to be rolled, are crossed relative to axes of the working rolls 1*a* and 1*b* and reinforcing rolls 2*a* and 2*b* in opposite directions.

Working roll chocks 4*a* are provided respectively at opposite ends of the working roll 1*a* to rotatably support this working roll 1*a,* and also working roll chocks 4*b* are provided respectively at opposite ends of the working roll 1*b* to rotatably support this working roll 1*b*. These working roll chocks 4*a* and 4*b* are connected to roll bending devices (for example, hydraulic cylinders) 8*a* and 8*b* mounted on project blocks 13 (described later), and a bending force is applied to the working rolls 1*a* and 1*b* by these roll bending devices 8*a* and 8*b* so that a roll curve (profile) can be formed into a convex shape or a concave shape.

Reinforcing roll chocks 5*a* are provided respectively at opposite ends of the reinforcing roll 2*a* to rotatably support this reinforcing roll 2*a*, and also reinforcing roll chocks 5*b* are provided respectively at opposite ends of the reinforcing roll 2*b* to rotatably support this reinforcing roll 2*b*. As shown in FIG. 2, an effective barrel length L of the reinforcing rolls 2*a* and 2*b* is smaller than the effective barrel length of the working rolls 1*a* and 1*b* and intermediate rolls 3*a* and 3*b*, and is larger than a width of a minimum-width strip to be rolled.

Intermediate roll chocks 6*a* are provided respectively at opposite ends of the intermediate roll 3*a* to rotatably support this intermediate roll 3*a*, and also intermediate roll chocks 6*b* are provided respectively at opposite ends of the intermediate roll 3*b* to rotatably support this intermediate roll 3*b*. Like the working roll chocks 4*a* and 4*b*, the intermediate roll chocks 6*a* and 6*b* are connected to roll bending devices (for example, hydraulic cylinders) 9*a*, mounted on the project blocks 13 (described later), and roll bending devices (for example, hydraulic cylinders) 9*b* mounted on the reinforcing roll chocks 5*a* and 5*b*. The intermediate rolls 3*a* and 3*b* can be bent into a convex shape or a concave shape by these roll bending devices 9*a* and 9*b*.

The working roll chocks 4*a* and 4*b*, the reinforcing roll chocks 5*a* and 5*b* and the intermediate roll chocks 6*a* and 6*b* are disposed in facing relation to window surfaces 11 of a pair of vertically-extending stands 10 spaced from each other in the direction of the axes of the rolls. A rolling load is applied to the rolls from compressing means, provided at upper or lower portions of the stands 10, thereby rolling the strip 12 to be rolled.

The project blocks 13 are mounted on the stands 10 facing the opposite sides of each of the intermediate rolls 3*a* and 3*b*, and in addition to the roll bending devices 8*a*, 8*b* and 9*a*, upper and lower hydraulic jacks 7*a* and 7*b* (only the upper jacks 7*a* are shown for the simplicity of the illustration) for setting or adjusting the cross angle of the upper and lower intermediate rolls 3*a* and 3*b* are mounted on the project blocks 13. The axes of the upper and lower intermediate rolls 3*a* and 3*b* can be inclined relative to the axes of the working rolls 1*a* and 1*b* and reinforcing rolls 2*a* and 2*b* by the hydraulic jacks 7*a* and 7*b*. In this embodiment, the working rolls 1*a* and 1*b* and the reinforcing rolls 2*a* and 2*b* are mounted in such a manner that their axes are perpendicular to the direction of rolling of the strip 12.

An oil supply header 20*a* is provided between the reinforcing roll 2*a* and the intermediate roll 3*a* while an oil supply header 20*b* is provided between the reinforcing roll 2*b* and the intermediate roll 3*b*. Similarly, an oil supply header 21*a* is provided between the intermediate roll 3*a* and the working roll 1*a* while an oil supply header 21*b* is provided between the intermediate roll 3*b* and the working roll 1*b*. These oil supply headers 20*a*, 20*b*, 21*a* and 21*b* serve to provide lubrication between the rolls, and extend along the axes of the rolls. In the case of hot rolling, suitable lubricating oil as disclosed in JP-A-5-50110 (U.S. Pat. Nos. 5,666,837 and 5,768,927) is injected from the headers 20 and 21 to the area of contact between the rolls, and in the case of cold rolling, known coolant oil for roll-cooling purposes or the like is injected from the oil supply headers 20 and 21 to the area of contact between the rolls. The positions of the these supply headers are not limited to the illustrated positions in FIG. 1.

The operation (driving) of the hydraulic jacks 7*a* and 7*b* for setting the cross angle of the intermediate rolls, the operation of the roll bending devices 8*a* and 8*b* for bending the working rolls, and the operation of the rolling bending devices 9*a* and 9*b* for bending the intermediate rolls are controlled in accordance with control signals from control device 100 (controller) provided in this rolling machine. Details thereof will now be described with reference to FIG. 3.

Figure 3:
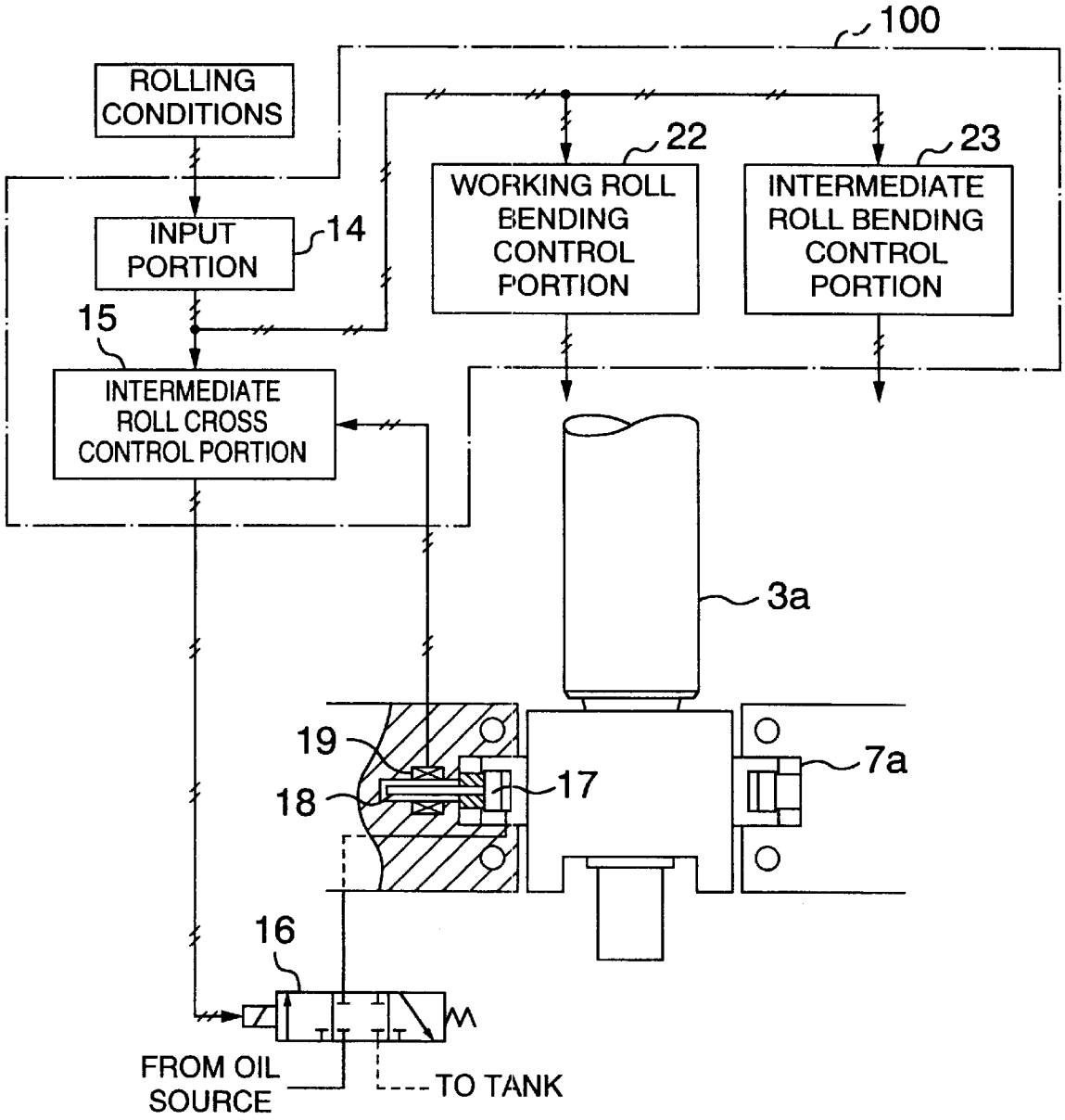
FIG. 3 is an illustration showing a drive control system for a hydraulic jack serving to set the cross angle of an upper intermediate roll.

FIG. 3 shows a drive control system for the hydraulic jack 7*a* serving to set the cross angle of the upper intermediate roll 3*a*. In FIG. 3, conditions, related to the material, dimensions, desired strip crown and shape of the strip 12 to be rolled and so on are inputted into an input portion 14 of the control device 100. Based on these conditions, the cross angle of the intermediate roll 3*a* is calculated in an intermediate roll cross control portion 15, and a signal, corresponding to the result of this calculation, is fed as an instruction to a directional control valve 16. On the other hand, pressurized oil is supplied to the hydraulic jack 7*a* from an oil source (not shown) via the directional control valve 16. At this time, the amount of movement of a ram 17 of the hydraulic cylinder 17*a* is detected by detecting the amount of displacement of a rod 18 (connected to the ram 17) by a displacement sensor 19, and this detection signal is fed back to the intermediate roll cross control portion 15. The intermediate roll cross control portion 15 adjusts the directional control valve 16 so that the cross angle of the intermediate roll 3*a* can become a predetermined angle. As a result, the cross angle of the intermediate roll 3*a* is set to the angle which meets the rolling conditions and the conditions related to the desired strip crown and shape.

A similar construction is provided for the hydraulic jack 7*b* for adjusting the lower hydraulic jack 7*b*, and a similar control is effected in accordance with a control signal from the intermediate roll cross control portion 15. The roll bending devices 8*a* and 8*b* for bending the working rolls are controlled in a similar manner as described above in accordance with a control signal fed from a working roll bending control portion 22 to which the input conditions are inputted from the input portion 14. Similarly, the intermediate roll bending devices 9*a* and 9*b* for bending the intermediate rolls are controlled in accordance with a control signal fed from an intermediate roll bending control portion 23 to which the input conditions are inputted from the input portion 14.

In the above construction, the hydraulic jacks 7*a* and 7*b*, the input portion 14 and the intermediate roll cross control portion 15 of the control device 100, the directional control valve 16, the hydraulic ram 17, the rod 18 and the displacement sensor 19 jointly constitute intermediate roll cross angle-adjusting means for adjusting the cross angle of the intermediate rolls.

Next, the operation of this embodiment of the above construction will be described.

(1) Intermediate Roll Cross (Securing of Adequate Strip Crown and Shape Control Capability for Large-Width Strip)

In this embodiment, the axes of the intermediate rolls 3*a* and 3*b*, disposed respectively in upper and lower substantially-horizontal planes, are crossed relative to the axes of the working rolls 1*a* and 1*b* and the axes of the reinforcing rolls 2*a* and 2*b* in the opposite directions.

Figure 4:
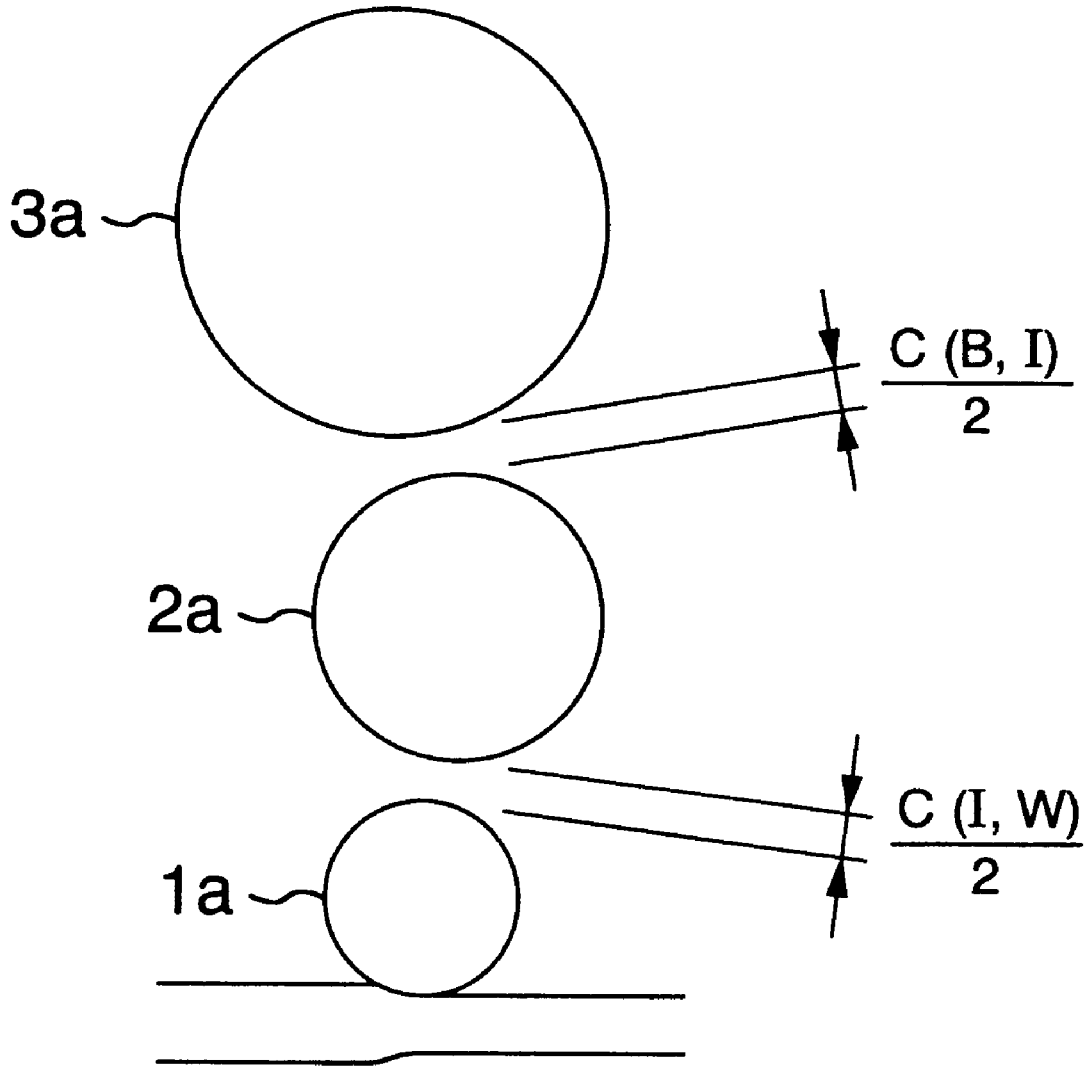
FIG. 4 is a view explaining a gap, formed between a reinforcing roll and the intermediate roll, and a gap formed between the intermediate roll and a working roll.

With this arrangement, as shown in FIG. 4, a gap (C (B, I)/2) is formed between the reinforcing roll 2*a* (2*b*) and the intermediate roll 3*a* (3*b*).

$$C(B,*I)/2=(2*b2*\theta2)/2(DB+DI)$$

Also, a gap (C (I, W)/2) is formed between the intermediate roll 3*a* (3*b*) and the working roll 1*a* (1*b*).

$$C(I,W)/2=(2*b2*\theta2)/2(DI+DW)$$

In the above formulas, DB represents the diameter of the reinforcing roll, DI represents the diameter of the intermediate roll, DW represents the diameter of the working roll, θ represents the cross angle of the intermediate roll, and b represents the distance from the cross point in the direction of the width of the strip.

The presence of the two gaps produces an effect equivalent to the effect of applying a roll crown CI to the intermediate roll 3*a*, 3*b*.

$$CI=C(B,I)/2+C(I,W)/2$$

Therefore, by suitably setting the cross angle θ of the intermediate roll 3*a*, 3*b*, CI can be adjusted, and as a result the strip crown and/or strip shape of the strip 12 to be rolled can be controlled through the working rolls 1*a* and 1*b*. Each of the two gaps, produced at this time, is increasing toward the opposite side edges of the strip, and therefore the adequate strip crown and shape control capability for a large-width strip can be obtained.

(2) Short Barrel Design of Reinforcing Rolls (Securing of Strip Crown and Shape Control Capability for Narrow-Width Strip, and So On)

As described in the above Item (1), the gap, formed between the intermediate roll 3*a* (3*b*) and the working roll 1*a* (1*b*) because of the crossing of the intermediate rolls 3*a* and 3*b*, as well as the gap formed between the intermediate roll 3*a* (3*b*) and the reinforcing roll 2*a* (2*b*), is decreasing toward the central portion. Therefore, this effect is lowered for a narrow-width strip whose width is smaller than the effective barrel length of the reinforcing rolls. In this embodiment, the reinforcing rolls 2*a* and 2*b* have a short barrel length, and this compensates for the above lowered effect, and therefore the high strip crown and shape control capability can be obtained even for a narrow-width strip. This will be described with reference to FIG. 5.

Figure 5:
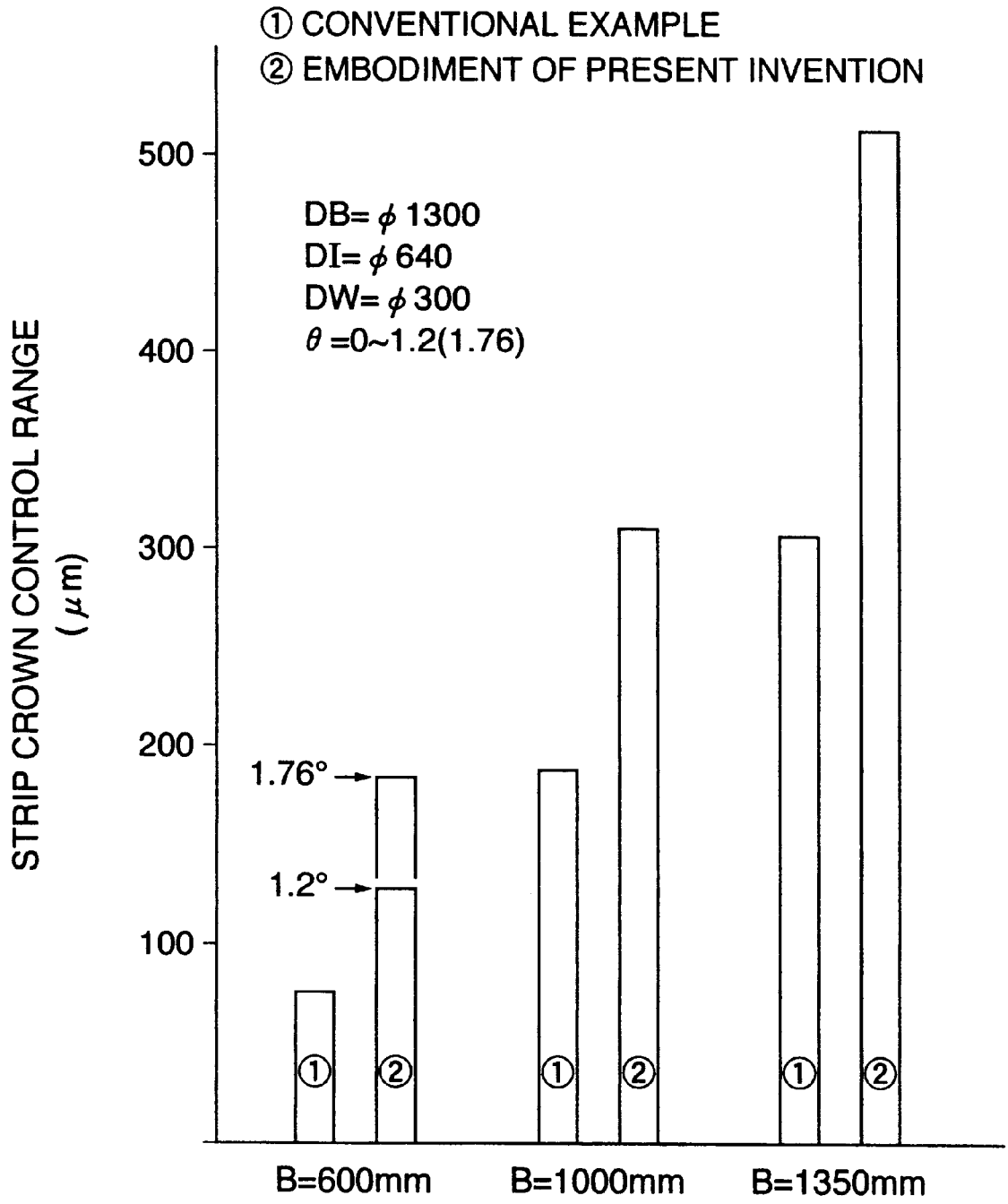
FIG. 5 is a diagram showing results of a simulation test for a strip crown control range, in which strips were rolled by rolling machine of FIG. 1.

FIG. 5 is a diagram showing results of a simulation test for a strip crown control range, in which strips were rolled by the rolling machine of this embodiment. With respect to simulation conditions, DB=1300 mm, DI=640 mm, DW=300 mm and the cross angle θ=1.2° were provided.

For comparison purposes, there are also shown results of a simulation test in which strips were rolled under the same conditions (but θ=0°), using a rolling machine (disclosed in JP-A-53-66849 (U.S. Pat. No. 4,194,382)) having reinforcing rolls with a short barrel length but having no crossing of intermediate rolls.

As shown in FIG. 5, in the rolling machine of this embodiment, the strip crown control range about twice larger than that of the conventional construction was obtained in the relatively wide range of strip widths from a relatively narrow width to a relatively large width (B=600 mm to 1350 mm).

In this case, if the reinforcing rolls 2*a* and 2*b* have the ordinary barrel length, so-called harmful contact portions are formed outwardly of the opposite side edges of the strip, which results in a disadvantage that the strip crown control is shifted toward the convex crown-producing side. However, with the short barrel length, the effect of preventing this disadvantage (a so-called HC effect and a bender-increasing effect can be obtained) can also be achieved.

(3) Adjustment of Cross Angle of Intermediate Rolls (Further Improvement of Strip Crown and Shape Control Capability for Narrow-Width Strip)

As described above in the above Items (1) and (2), in the rolling machine of this embodiment, the strip crown and shape control capability for strips of various widths from a narrow width to a large width can be enhanced with the crossing of the intermediate rolls and the short barrel length of the reinforcing rolls. However, as shown in FIG. 5, the absolute value of the strip crown control range for narrow-width strips is extremely smaller than that of the strip crown control range for large-width strips as in the conventional construction, and in this respect, there is still room for improvement.

In this embodiment, as described above, in accordance with the control signal from the intermediate roll cross control portion 15 of the control device 100, the cross angle θ of the intermediate rolls 3*a* and 3*b* can be adjusted through the directional control valves 16 and the hydraulic jacks 7*a* and 7*b* (In this case, the adjustment includes both the pre-setting of the cross angle, effected before the start of the rolling, and a change of the cross-angle effected during the rolling). Therefore, the maximum cross angle at the time of rolling a narrow-width strip and the maximum cross angel at the time of rolling a large-width strip are changed, and also the maximum cross angle at the time of rolling a narrow-width strip is larger than the maximum cross angle at the time of rolling a large-width strip. By doing so, the control range for a narrow-width strip is increased, thereby decreasing the difference between this control range and the control range for a large-width strip, so that the strip crown and shape control capability for a narrow-width strip can be improved. Referring to one specific example thereof, in the case of B=600 mm in FIG. 5, the cross angle θ was increased from 1.2° to 1.76°, and by doing so, the strip crown control range could be greatly increased. In this manner, the adequate strip crown and shape control capability can be secured for strips of various widths from a narrow width to a large width.

Figure 6A:
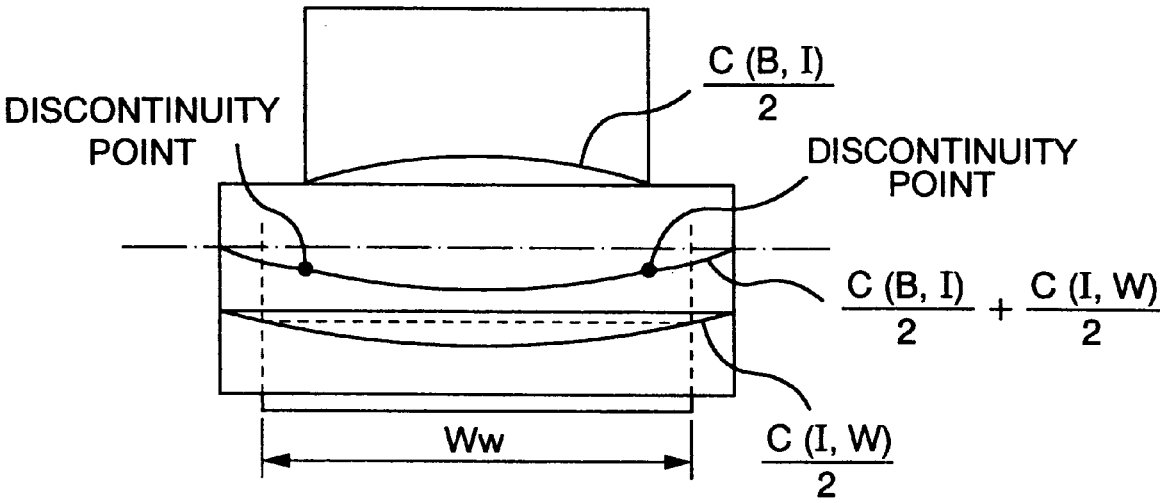
FIGS. 6A and 6B are illustrations of an apparent crown applied to the intermediate roll by the rolling machine of FIG. 1
Figure 6B:
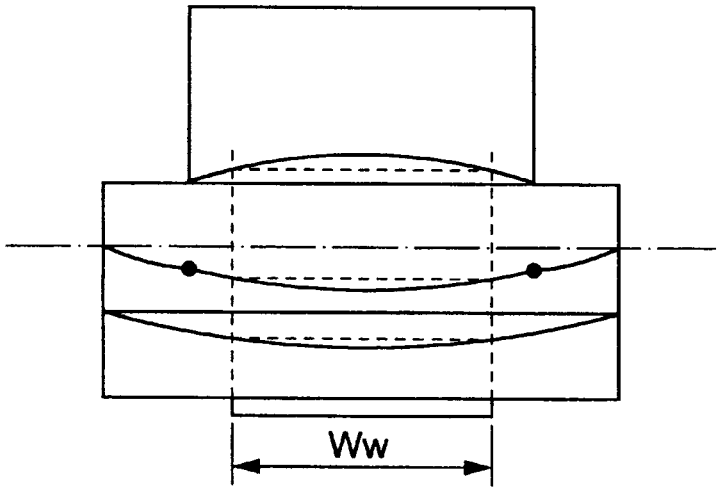

When the strip crown and shape control for a large-width strip is effected, the opposite side edges of the strip are disposed outwardly of the opposite ends of the reinforcing rolls 2*a* and 2*b* since the reinforcing rolls 2*a* and 2*b* have the short barrel length, and therefore in some cases, discontinuity points develop on the apparent roll crown (CI=C(B, I)/2+C(I,W)/2) applied to the intermediate rolls, as shown in FIG. 6A. However, in the case where the gap to be formed between the intermediate roll and the working roll is the same, the cross angle θ for a large-width strip can be smaller than that for a narrow-width strip, and because of this nature, the intermediate roll cross angle θ to be set when rolling a large-width strip can be relatively small. Therefore, these discontinuity points will not become conspicuous, and hence any substantial disturbance, which would adversely affect the control, will not occur. In the case of a narrow-width strip, the discontinuity points on the intermediate roll crown are disposed outwardly of the opposite side edges of the strip as shown in FIG. 6B, and therefore will not affect the strip crown.

(4) Setting of Upper Limit of the Intermediate Roll Cross Angle at the Time of Rolling Narrow-Width Strip Generally, when an axis of a roll is crossed at a cross angle θ relative to another roll, the displacement s (from the original axis) at a position, axially spaced a distance b from the cross point, is expressed by s=bθ. If a strip width is represented by W, a formula, s=W×θ/2, is established.

Here, if this value is set to an excessively-large value, a good condition of contact between the rolls can not be maintained. Therefore, usually, the predetermined upper limit value s max of s exists in order to maintain the good condition of contact between the rolls. Preferably, this upper limit value is always maintained even if the strip width and the cross angle are changed.

The value of s becomes the largest when a large-width strip with a maximum width is rolled with the maximum cross angle, and therefore in this case, if this maximum strip width is represented by Wwmax, the maximum cross angle is represented by θ wmax, and the displacement is represented by s wmax, then the following formula is established:

$$s\ wmax = Wwmax \times \theta\ wmax/2$$

On the other hand, in this embodiment, the maximum cross angle is increased when rolling a narrow-width strip, and in this case, if this strip width is represented by Wn, and the maximum cross angle is represented by θ nmax (≧θ wmax), the displacement s nmax is expressed by the following formula:

$$s\ nmax = Wn \times \theta\ nmax/2$$

For the above reason, preferably, s nmax is not more than s wmax as expressed in the following:

$$s\ nmax \leqq s\ wmax$$

Therefore, the following formulas are established:

$$Wn \times \theta\ nmax/2 \leqq Wwmax \times \theta\ wmax/2$$

$$\theta\ nmax \leqq \theta\ wmax \times (Wwmax/Wn)$$

θ nmax≧θ wmax is established as described above, and therefore the following formula is established:

$$\theta\ wmax \leqq \theta\ nmax \leqq \theta\ wmax \times (Wwmax/Wn)$$

Namely, the maximum cross angle θnmax of the intermediate rolls 3*a* and 3*b* for the narrow width Wn is set to not more than a value obtained by multiplying the θwmax (for the maximum strip width Wwmax) by (the maximum strip width/strip width of narrow-width strip to be rolled), and by doing so, the good condition of contact between the rolls can be maintained.

(5) Reduction of Thrust Force

In this embodiment, the intermediate rolls 3*a* and 3*b* are crossed relative to the reinforcing rolls 2*a* and 2*b* and the working rolls 1*a* and 1*b*. In this case, a thrust force is produced between the reinforcing roll 2*a*, 2*b* and the intermediate roll 3*a*, 3*b* in the direction of the axes of the rolls, and also a thrust force is produced between the intermediate roll 3*a*, 3*b* and the working roll 1*a*, 1*b* in the direction of the axes of the rolls. Generally, this thrust force is represented by (thrust coefficient)×(rolling load).

The intermediate roll 3*a*, 3*b* is interposed between the reinforcing roll 3*a*, 3*b* and the working roll 1*a*, 1*b*, and therefore the thrust forces, acting respectively on the upper and lower sides of the intermediate roll 3*a*, 3*b* cancel each other. However, the thrust force, acting on the reinforcing roll 2*a*, 2*b*, as well as the thrust force acting on the working roll 1*a*, 1*b*, remains. Therefore, in this embodiment, as described above, roll-lubricating oil is injected to the area of contact between the reinforcing roll 2*a*, 2*b* and the intermediate roll 3*a*, 3*b*, and also roll-lubricating oil is injected to the area of contact between the intermediate roll 3*a*, 3*b* and the working roll 1*a*, 1*b*. By doing so, the thrust force is reduced. Of course, this lubricating oil can be coolant oil for roll-cooling purposes.

Figure 7:
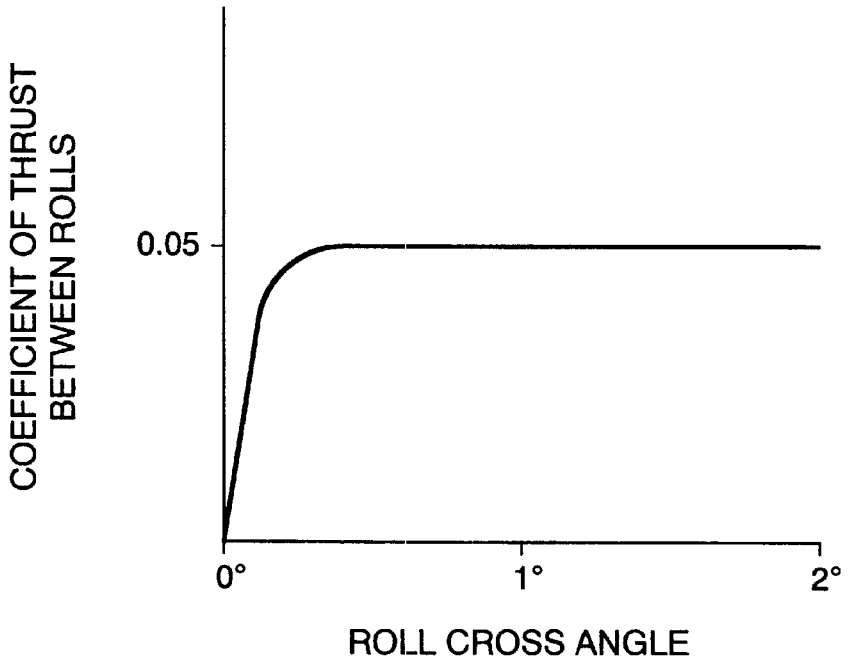
FIG. 7 is a diagram showing thrust coefficient characteristics obtained when supplying lubricating oil to the rolls.

It is known that by injecting suitable lubricating oil (as disclosed in JP-A-5-50110) to the area of contact between the rolls in the cast of hot rolling and by injecting known coolant oil for roll-cooling purposes or the like in the case of cold rolling as described above, thrust coefficient characteristics as shown in FIG. 7 can be obtained. More specifically, the thrust coefficient abruptly rises in the region where the cross angle is close to zero, and is very small. However, when the cross angle exceeds a certain value, the thrust coefficient becomes almost constant (for example, 0.5) regardless of the value of the cross angle. Therefore, even if the maximum cross angle of the intermediate rolls for a narrow-width strip is set to a value larger than a value of the maximum cross angle for a large-width strip, the thrust coefficient hardly changes. Therefore, even if the maximum cross angle of the intermediate rolls 3*a* and 3*b* is set to a value larger than a value of the maximum cross angle for a large-width strip as in this embodiment, the thrust force can be kept sufficiently low.

As described above, in this embodiment, the strip crown and shape control capability for a narrow-width strip is improved, and the adequate strip crown and shape control capability for strips of various widths from a narrow width to a large width can be secured. And besides, the cross angle of the intermediate rolls can be adjusted easily and rapidly even in a loaded condition during the rolling operation, and therefore the strip crown and/or the strip shape can be controlled during the rolling such as continuous rolling.

Figure 8:
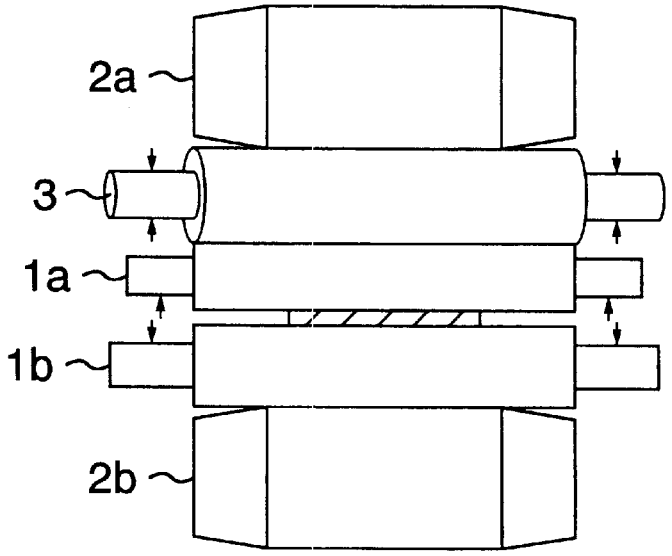
FIG. 8 is a side-elevational view showing the arrangement of rolls in a five-stage rolling machine according to a modified form of the invention.

Although the above embodiment is directed to the six-stage rolling machine, the present invention is not limited to such a rolling machine, but can be applied to a five-stage rolling machine as shown in FIG. 8. Suitable modifications can be made without departing from the scope of the invention.

Figure 9:
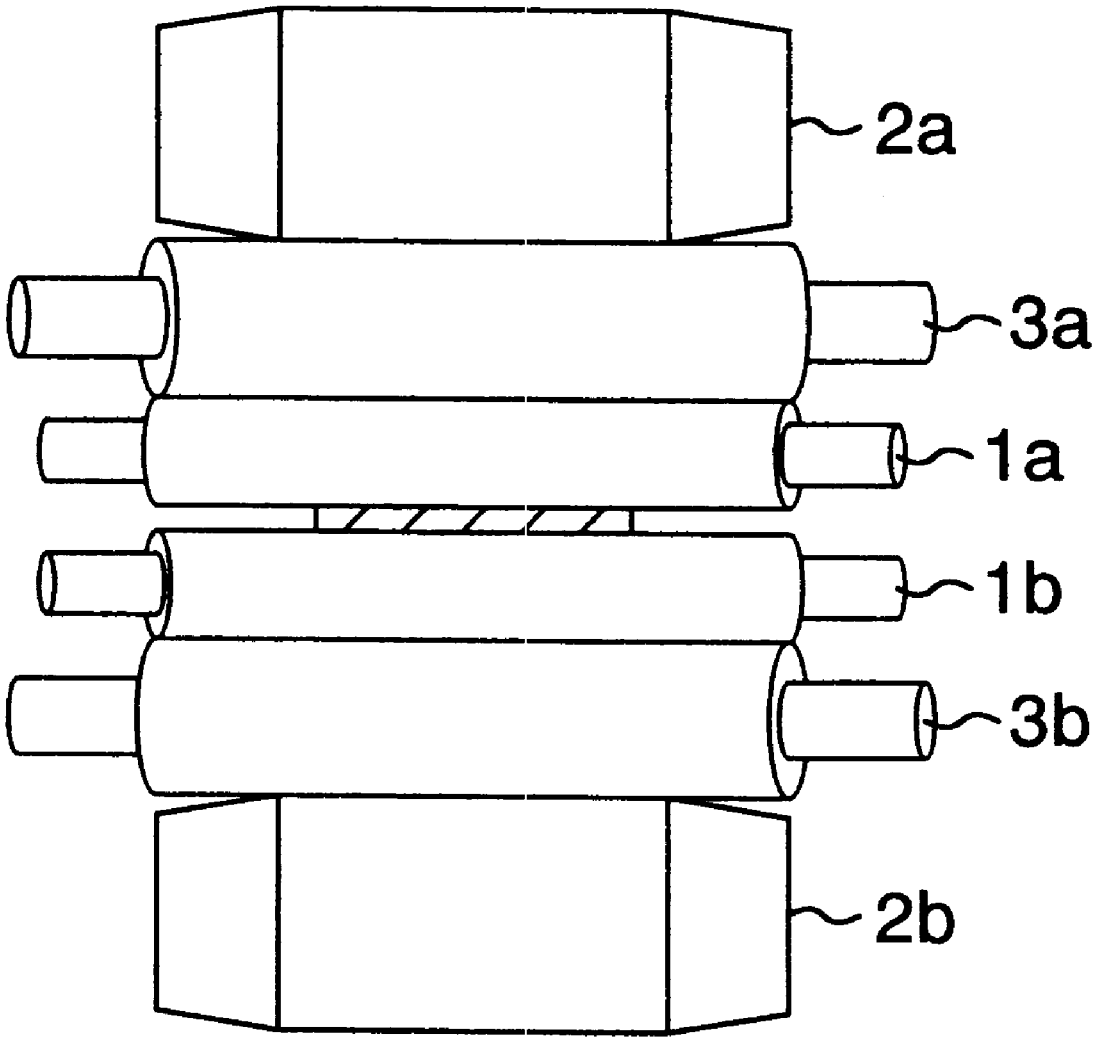
FIG. 9 is a side-elevational view showing the arrangement of rolls in a six-stage rolling machine of the working roll-type according to another modified form of the invention.

When it is desired to reduce the diameter of working rolls, there is provided a rolling machine as shown in FIG. 9, in which each working roll is crossed relative to a corresponding intermediate roll (which is crossed) in a direction opposite to the direction of crossing of the intermediate roll, thereby reducing a thrust force in the direction of the axis of the working roll. The present invention can be applied to such a rolling machine.

Furthermore, the present invention can be applied to known taper-variable BUR and VC rolls in which a profile is changed by a hydraulic pressure.

In each of the above cases, effects generally similar to those of the above embodiment can be obtained.

In the present invention, the strip crown and shape control capability for a narrow-width strip is improved, and the adequate strip crown and shape control capability for strips of various widths from a narrow width to a large width can be secured. Therefore, strip products of a high quality in the wide range of widths can be produced.

What is claimed is:

1. A rolling machine comprising:

a pair of upper and lower working rolls for rolling a strip, said working rolls having a predetermined effective barrel length, and said working rolls being arranged substantially parallel to a direction of a width of the strip to be rolled;

a pair of upper and lower intermediate rolls supporting said working rolls, respectively, said intermediate rolls having a predetermined effective barrel length;

a pair of upper and lower reinforcing rolls supporting said intermediate rolls, respectively, said reinforcing rolls having an effective barrel length which is smaller than the effective barrel length of said working rolls and said intermediate rolls, and is larger than a width of a minimum-width strip to be rolled:

intermediate roll cross device for crossing axes of said pair of intermediate rolls, disposed respectively in substantially horizontal planes, relative to the direction of the width of the strip to be rolled;

first supply means provided at a rolling inlet side for supplying a fluid to an area of contact between each intermediate roll and the associated reinforcing roll so as to reduce a thrust force;

second supply means provided at a rolling outlet side for supplying a fluid to an area of contact between each working roll and the associated intermediate roll so as to reduce a thrust force;

at least one of an intermediate roll bending device and a working roll bending device, said intermediate roll bending device applying a bending force to said intermediate rolls while said working roll bending device applies a bending force to said working rolls;

a rolling condition-inputting device for inputting rolling conditions;

a cross-angle control device for calculating an amount of a cross angle of said intermediate rolls in accordance with the rolling conditions from said rolling condition-inputting device so as to control the maximum cross angle as a function of the width of a strip to be rolled; and a bending control device for controlling the bending of said intermediate rolls or the bending of said working rolls in accordance with the rolling conditions from said rolling condition-inputting device.

2. A rolling machine comprising:

a pair of upper and lower working rolls;

a pair of upper and lower intermediate rolls supporting said working rolls, respectively;

a pair of upper and lower reinforcing rolls supporting said intermediate rolls, respectively, said pair of reinforcing rolls having an effective barrel length smaller than an effective barrel length of said working rolls and said intermediate rolls, and larger than a width of a minimum-width strip to be rolled;

said pair of intermediate rolls being arranged in such a manner that their axes, disposed respectively in substantially horizontal planes, cross each other, and are disposed to be crossed relative to said pair of working rolls and said pair of reinforcing rolls; and intermediate roll cross angle-adjusting means for adjusting a maximum cross angle of said intermediate rolls as a function of a width of strip to be rolled.

3. A rolling machine according to claim 2, wherein said intermediate roll cross angle-adjusting means adjusts the cross angle such that the maximum cross angle of said intermediate roll at the time of rolling a narrow-width strip, having a width smaller than the effective barrel length of said reinforcing roll, is larger than the maximum cross angle of said intermediate roll at the time of rolling a maximum-width strip.

4. A rolling machine according to claim 2, further comprising intermediate roll bending means for applying a bending force to said intermediate roll.

5. A rolling machine according to claim 2, further comprising working roll bending means for applying a bending force to said working rolls.

6. A rolling machine according to claim 3, wherein said intermediate roll cross angle-adjusting means adjusts the maximum cross angle θ nmax of said intermediate roll at the time of rolling the narrow-width strip, having the width Wn smaller than the effective barrel length L of said reinforcing roll, so as to satisfy the following formula:

$$\theta\ wmax \leqq \theta\ nmax \leqq \theta\ wmax \times (Wwmax/Wn)$$

where θ wmax represents the maximum cross angle of said intermediate roll at the time of rolling the maximum-width strip having the maximum width Wwmax.

7. A rolling method of rolling by supporting a pair of upper and lower working rolls respectively by a pair of upper and lower intermediate rolls, and supporting said intermediate rolls respectively by a pair of upper and reinforcing rolls, said method comprising the steps of:

providing said pair of reinforcing rolls having an effective barrel length which is smaller than an effective barrel length of said working rolls and said intermediate rolls, and is larger than a width of a minimum-width strip to be rolled;

arranging, in the rolling of the strip, said pair of intermediate rolls in such a manner that their axes, disposed respectively in substantially horizontal planes, cross each other, and are crossed relative to said pair of working rolls and said pair of reinforcing rolls; and adjusting a maximum cross angle of said intermediate rolls as a function of a width of a strip to be rolled by intermediate roll cross angle-adjusting means.

8. A rolling method according to claim 7, wherein said intermediate roll cross angle-adjusting means adjusts the cross angle such that the maximum cross angle of said intermediate roll at the time of rolling a narrow-width strip, having a width smaller than the effective barrel length of said reinforcing roll, is larger than the maximum cross angle of said intermediate roll at the time of rolling a maximum-width strip.

9. A rolling method according to claim 7, further comprising the step of rolling while applying a bending force to said intermediate roll by intermediate roll bending means during the rolling.

10. A rolling method according to claim 7, further comprising the step of rolling while applying a bending force to said working rolls by working roll bending means during the rolling.

11. A rolling method according to claim 8, wherein said intermediate roll cross angle-adjusting means adjusts the maximum cross angle θ nmax of said intermediate roll at the time of rolling the narrow-width strip, having the width Wn smaller than the effective barrel length L of said reinforcing roll, so as to satisfy the following formula:

$$\theta\ wmax \leqq \theta\ nmax \leqq \theta\ wmax \times (Wwmax/Wn)$$

where θ wmax represents the maximum cross angle of said intermediate roll at the time of rolling the maximum-width strip having the maximum width Wwmax.

12. A rolling machine comprising:

a pair of upper and lower working rolls;

a pair of upper and lower reinforcing rolls;

one intermediate roll provided between said upper working roll and said upper reinforcing roll or between said lower working roll and said lower reinforcing roll, said intermediate roll being arranged in such a manner that said intermediate roll, disposed in a substantially horizontal plane, is disposed to be crossed relative to said pair of working rolls and said pair of reinforcing rolls; and intermediate roll cross angle-adjusting means for adjusting a maximum cross angle of said intermediate roll as a function of a width of a strip to be rolled;

said reinforcing roll, disposed adjacent to said intermediate roll, having an effective barrel length smaller than an effective barrel length of said working rolls and said intermediate roll, and larger than a width of a minimum-width strip to be rolled.

13. A rolling machine according to claim 12, wherein said intermediate roll cross angle-adjusting means adjusts the cross angle such that the maximum cross angle of said intermediate roll at the time of rolling a narrow-width strip, having a width smaller than the effective barrel length of said reinforcing roll, is larger than the maximum cross angle of said intermediate roll at the time of rolling a maximum-width strip.

14. A rolling machine according to claim 12, further comprising intermediate roll bending means for applying a bending force to said intermediate roll.

15. A rolling machine according to claim 12, further comprising working roll bending means for applying a bending force to said working rolls.

16. A rolling machine according to claim 3, wherein said intermediate roll cross angle-adjusting means adjusts the maximum cross angle θ nmax of said intermediate roll at the time of rolling the narrow-width strip, having the width Wn smaller than the effective barrel length L of said reinforcing roll, so as to satisfy the following formula:

$$\theta\ wmax \leqq \theta\ nmax \leqq \theta\ wmax \times (Wwmax/Wn)$$

where θ wmax represents the maximum cross angle of said intermediate roll at the time of rolling the maximum-width strip having the maximum width Wwmax.

17. A rolling method of rolling by providing one intermediate roll between an upper working roll and an upper reinforcing roll or between a lower working roll and a lower reinforcing roll, said method comprising the steps of:

preparing said reinforcing roll, disposed adjacent to said intermediate roll, having an effective barrel length which is smaller than an effective barrel length of said working rolls and said intermediate roll, and is larger than a width of a minimum-width strip to be rolled; and arranging, in the rolling of the strip, said intermediate roll in such a manner that said intermediate roll, disposed in a substantially horizontal plane, is crossed relative to said pair of working rolls and said pair of reinforcing rolls; and adjusting a maximum cross angle of said intermediate roll as a function of a width of a strip to be rolled by intermediate roll cross angle-adjusting means.

18. A rolling method according to claim 17, wherein said intermediate roll cross angle-adjusting means adjusts the cross angle such that the maximum cross angle of said intermediate roll at the time of rolling a narrow-width strip, having a width smaller than the effective barrel length of said reinforcing roll, is larger than the maximum cross angle of said intermediate roll at the time of rolling a maximum-width strip.

19. A rolling method according to claim 17, further comprising the step of rolling while applying a bending force to said working rolls by working roll bending means during the rolling.

20. A rolling method according to claim 17, further comprising the step of rolling while applying a bending force to said intermediate roll by intermediate roll bending means during the rolling.

21. A rolling method according to claim 17, further comprising the step of rolling while applying a bending force to said working rolls by working roll bending means during the rolling.

22. A rolling machine comprising:

a pair of upper and lower working rolls for rolling a strip, said working rolls having a predetermined effective barrel length;

a pair of upper and lower intermediate rolls supporting said working rolls, respectively, said intermediate rolls having a predetermined effective barrel length;

a pair of upper and lower reinforcing rolls supporting said intermediate rolls, respectively, said reinforcing rolls having an effective barrel length which is smaller than the effective barrel length of said working rolls and said intermediate rolls, and is larger than a width of a minimum-width strip to be rolled; and an intermediate roll cross device for crossing axes of said pair of intermediate rolls, disposed respectively in substantially horizontal planes, relative to a direction of the width of the strip to be rolled, said intermediate roll cross device being provided with intermediate roll adjusting means for adjusting a maximum cross angle as a function of a width of the strip to be rolled.

23. A rolling machine comprising:

a pair of upper and lower working rolls for rolling a strip, said working rolls being arranged substantially parallel to a direction of a width of the strip to be rolled;

a pair of upper and lower intermediate rolls supporting said working rolls, respectively;

a pair of upper and lower reinforcing rolls supporting said intermediate rolls, respectively, said reinforcing rolls having an effective barrel length which is smaller than the effective barrel length of said working rolls and said intermediate rolls, and is larger than a width of a minimum-width strip to be rolled; and an intermediate roll cross device for crossing axes of said pair of intermediate rolls, disposed respectively in substantially horizontal planes, relative to a direction of the width of the strip to be rolled, said intermediate roll cross device being provided with intermediate roll adjusting means for adjusting a maximum cross angle as a function of a width of the strip to be rolled.

24. A rolling machine comprising:

a pair of upper and lower working rolls for rolling a strip, said working rolls having a predetermined effective barrel length;

a pair of upper and lower intermediate rolls supporting said working rolls, respectively, said intermediate rolls having a predetermined effective barrel length;

a pair of upper and lower reinforcing rolls supporting said intermediate rolls, respectively, said reinforcing rolls having an effective barrel length which is smaller than the effective barrel length of said working rolls and said intermediate rolls;

an intermediate roll cross device for crossing axes of said pair of intermediate rolls, disposed respectively in substantially horizontal planes, relative to a direction of a width of the strip to be rolled; and a cross angle control device for adjusting an amount of the maximum cross angle of said intermediate rolls in accordance with the width of the strip to be rolled.

* * * * *

UNITED STATES PATENT AND TRADEMARK OFFICE

CERTIFICATE OF CORRECTION

PATENT NO : 6,151,943

DATED : November 28, 2000

INVENTOR(S) : Nihei et al.

It is certified that error appears in the above-identified patent and that said Letters Patent is hereby corrected as shown below:

On the title page, item [30], should read:

Foreign Application Priority Data

July 21, 1998 [JP] Japan . . . . . 10-204748

Signed and Sealed this

Eighth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,151,943
DATED : November 28, 2000
INVENTOR(S) : Nihei et al.

It is certified that error appears in the above-identified patent and that said Letters Patent is hereby corrected as shown below:

[30] Foreign Application Priority Data

July 21, 1998 [JP] Japan ..... 10-2047-48

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,151,943
DATED : November 28, 2000
INVENTOR(S) : Mistsuo Nihei et al.

It is certified that error appears in the above-identified patent and that said Letters Patent is hereby corrected as shown below:

This certificate supersedes Certificate of Correction issued September 25, 2001. The certificate was issued in error and should be deleted.

Signed and Sealed this

Fourth Day of June, 2002

*Attest:*

*Attesting Officer*

JAMES E. ROGAN
*Director of the United States Patent and Trademark Office*